US008174342B2

(12) United States Patent
Min et al.

(10) Patent No.: US 8,174,342 B2
(45) Date of Patent: May 8, 2012

(54) MICROELECTROMECHANICAL SYSTEM

(75) Inventors: Tang Min, Singapore (SG); Liao Ebin, Singapore (SG); Giuseppe Noviello, Singapore (SG); Francesco Italia, Singapore (SG)

(73) Assignee: STMicroelectronics NV, Geneva (CH)

( * ) Notice: Subject to any disclaimer, the term of this patent is extended or adjusted under 35 U.S.C. 154(b) by 236 days.

(21) Appl. No.: 12/475,392

(22) Filed: May 29, 2009

(65) Prior Publication Data

US 2010/0171575 A1 Jul. 8, 2010

Related U.S. Application Data

(60) Provisional application No. 61/142,572, filed on Jan. 5, 2009.

(51) Int. Cl.
*H01P 1/10* (2006.01)
*H01H 55/00* (2006.01)

(52) U.S. Cl. ..... 333/262; 335/78

(58) Field of Classification Search ..... 333/101, 333/105, 262; 335/78
See application file for complete search history.

(56) References Cited

U.S. PATENT DOCUMENTS 6,016,092 A * 1/2000 Qiu et al. ..... 333/262
6,496,612 B1 * 12/2002 Ruan et al. ..... 385/18
7,023,304 B2 * 4/2006 Shen et al. ..... 335/78

* cited by examiner

*Primary Examiner* — Dean O Takaoka
(74) *Attorney, Agent, or Firm* — Hogan Lovells US LLP

(57) ABSTRACT

The invention relates to microelectromechanical systems (MEMS), and more particularly, to MEMS switches using magnetic actuation. The MEMS switch may be actuated with no internal power consumption. The switch is formed in an integrated solid state MEMS technology. The MEMS switch is micron and/or nanoscale, very reliable and accurate. The MEMS switch can be designed into various architectures, e.g., a cantilever architecture and torsion architecture. The torsion architecture is more efficient than a cantilever architecture.

20 Claims, 3 Drawing Sheets

MICROELECTROMECHANICAL SYSTEM

This application claims the benefit of U.S. Provisional Patent Application No. 61/142,572, filed on Jan. 5, 2009, which is hereby incorporated by reference for all purposes as if fully set forth herein.

BACKGROUND OF THE INVENTION

1. Field of the Invention

The invention relates to microelectromechanical systems (MEMS), and more particularly, to MEMS switches using magnetic actuation.

2. Discussion of the Related Art

Some related art electrical switches are controlled with an electrical circuit such as a reed relay. A reed relay is an electrical switch and is a very common electronic component widely used in many applications. Typically, a reed relay includes a glass package having two metal contacts. The metal contacts may be actuated with a magnetic field. The related art reed relay is large, delicate and not reliable for many applications. Some other related art electronic switches are based on magnetic effect like the Hall effect or giant magneto resistance effect (GMR). Such electronic switches are better alternatives to the reed relay switches, but they have a power consumption drawback. That is, as more and more electronic circuit applications are battery operated, the benefits of an integrated switch having power consumption is problematic.

SUMMARY OF THE INVENTION

Accordingly, the invention is directed to a microelectromechanical system that substantially obviates one or more of the problems due to limitations and disadvantages of the related art.

An advantage of the invention is to provide a MEMS switch that is formed in an integrated solid state MEMS technology.

Another advantage of the invention is to provide a MEMS switch formed on the micron or nanoscale that is very reliable and accurate in its operation.

Yet another advantage of the invention is to provide a MEMS switch with a cantilever architecture.

Still another advantage of the invention is to provide a MEMS switch with a torsion architecture.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the invention, as embodied and broadly described, an embodiment of the invention is directed towards a MEMS switch including a substrate. Input and output contacts are formed on the substrate. A movable structure is supported over at least a portion of the substrate. The movable structure includes a proximal end portion, an intermediate portion and a distal end portion. The movable structure is supported over at least a portion of the output contact and in an electrical contact with the input contact. The MEMS switch is capable of actuation upon an application of an external magnetic field.

In another embodiment of the invention, a MEMS switch is formed on a substrate. The switch includes an input electrode and output electrode on the substrate. A structure is formed on the input electrode to support a movable structure over at least a portion of the substrate. The movable structure includes a proximal end portion, an intermediate portion and a distal end portion. The movable structure is coupled to the intermediate portion of the movable structure and is capable of actuation upon an application of an external magnetic field.

In yet another embodiment of the invention, a MEMS switch is formed on a substrate. The MEMS switch includes an insulating layer on the substrate and an input electrode on the insulating layer. Further, the switch includes an output electrode on the substrate and a movable support structure electrically coupled to an input electrode. The movable support structure includes a support structure and a plurality of thin, magnetic permalloy strips and is configured to move from a first position to a second position with an external magnetic field to activate the MEMS switch.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Figure 1:
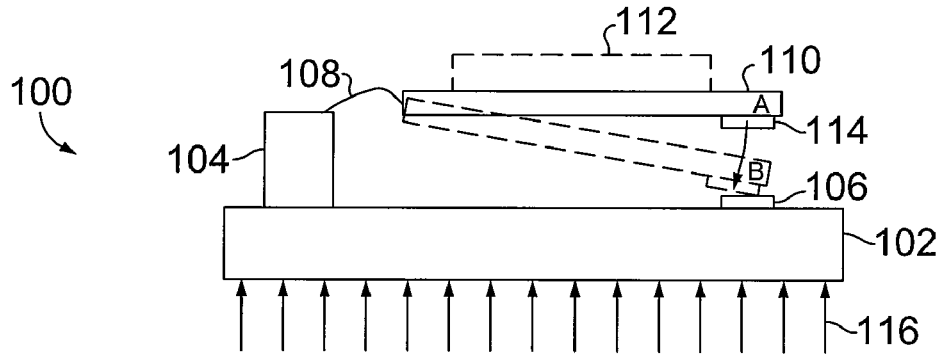
FIG. 1 illustrates a side view of a MEMS switch according to an embodiment of the invention.

The invention relates to microelectromechanical systems, and more particularly, to MEMS switches using magnetic actuation. The MEMS switch may be actuated with no internal power consumption. That is, the switch may be actuated with an external magnetic field. The switch is formed in an integrated solid state MEMS technology. The MEMS switch is formed on the micron or nanoscale and very reliable and accurate. The MEMS switch can be designed into various architectures, e.g., a cantilever architecture and torsion architecture. The torsion architecture is more efficient than a cantilever architecture.

In one embodiment, a MEMS switch is formed on a substrate. The substrate may be a silicon on insulator (SOI) substrate, glass substrate, silicon (Si) substrate, plastic substrate, and the like. Other substrates may also be used.

The substrate may include insulating material. The insulating material may be formed into a thin insulator layer. The insulating material may be a dielectric layer, e.g., $SiO_2$, SiN and the like. An input contact and output contact are formed on the substrate. The input contact provides input to the MEMS switch and the output contact provides output to the MEMS switch. A movable structure is supported over at least a portion of the substrate. The support location of the movable structure depends on whether the MEMS switch is a cantilever architecture or torsion architecture. The movable structure includes a proximal end portion, an intermediate portion and a distal end portion. The movable structure is supported with at least one of the proximal end portion or intermediate portion. The proximal end portion support is utilized in the cantilever architecture while the intermediate portion is utilized in the torsion architecture. Optionally, an electrical contact can be formed on the distal end portion of the movable structure.

The movable structure is capable of actuation upon application of an external magnetic field. That is, the movable structure moves in order to provide electrical connection between the input contact and output contact through at least a portion of the movable structure. The input contact and output contact can be switched throughout such that the input is the output and vice versa. This is clearly within the scope of one of ordinary skill in the art. The movable structure may be configured into a plurality of different geometric configurations. For example, the movable structure may be configured into a beam and formed with a support structure.

In a preferred embodiment, the movable structure is formed on a support structure. The support structure is formed of conductive and/or magnetic material. The conductive material may be an alloy or pure material, e.g., gold, copper, and the like. The movable structure may be formed on the support structure and include a plurality of thin film magnetic material. The thin film magnetic material comprises magnetic material such as an alloy. In a preferred embodiment, the alloy includes NiFe, CoNi, and the like. The thin film may be formed with deposition techniques as known in the art such as chemical deposition process, physical deposition process, and the like. In a preferred embodiment, the thin film is deposited with electrical plating process.

The thin film magnetic material may be deposited into interconnected strips on top of another structure or may independently form its own structure. The arrangement of thin film into long narrow strips minimizes demagnetization effect. The strips can be formed to have a width ranging from about 1 μm to about 1000 μm length ranging from about 10 μm to about 1000 μm and a height ranging from about 0.1 μm to about 100 μm. The aspect ratio of length/width, length/height, and width/height is greater than 1. In a preferred embodiment, the aspect ratio is not less than 5.

The actuation of the switch is achieved by placing the MEMS switch into a magnetic field. The actuation may be achieved without the application of electrical power to the MEMS switch. The MEMS switch may be used to transmit information to other electrically connected circuits or devices coupled to the MEMS switch.

The magnetic field may be passive, active or a combination of passive and active. An active magnetic field is generated with coils, e.g., in-plane spiral coil, multilevel meander magnetic core, and the like. A passive magnetic field is generated with a permanent magnet, e.g., Neodymium Iron Boron (NdFeB) magnet, samarium cobalt (SmCo) magnet, and the like.

Reference will now be made in detail to embodiments of the invention, examples of which are illustrated in the accompanying drawings.

FIG. 1 illustrates a side view of a MEMS switch according to an embodiment of the invention.

Referring to FIG. 1, the MEMS switch is generally depicted as reference number 100. The MEMS switch 100 is formed on a substrate 102 such as silicon, glass, and the like. An input contact 104 of the switch is formed on the substrate 102. An output contact 106 is formed on the substrate 102. The input and output contacts are formed with electrically conductive material or an alloy of the same, e.g., gold or gold-alloy. The input contact and output contacts are electrically connected to other circuits (not shown) and devices (not shown) formed on said substrate.

A movable structure 110 is coupled to a flexure 108. The flexure 108 is electrically coupled to the input contact 104 and designed to permit movement of the movable structure from a first position (A) to a second position (B) upon application of an external force. The first position (A) is an open position for the switch and the second position (B) is a closed position for the switch. The flexure 108 permits the structure to return to the first position (A) after application of the external force.

In this embodiment, the movable structure 110 includes a magnetic material such as NiFe, CoNi, and the like. Optionally, the movable structure 110 includes additional material 112 formed on the movable structure 110 to balance stress. Also, optionally, an electrical contact 114 may be formed on the structure 110.

In operation, an external magnetic field 116 is applied to the MEMS switch 100. The movable structure 110 moves from a first position (A) (open) to a second position (B) (closed) permitting contact of at least a portion of the structure 110 with the output 106, thereby permitting an electrical current to travel from the input contact 104 to the output contact 106. In absence of the magnetic field 116 the structure returns to the first position. (A). The external magnetic field may be passive, active or a combination of the same.

Figure 2A:
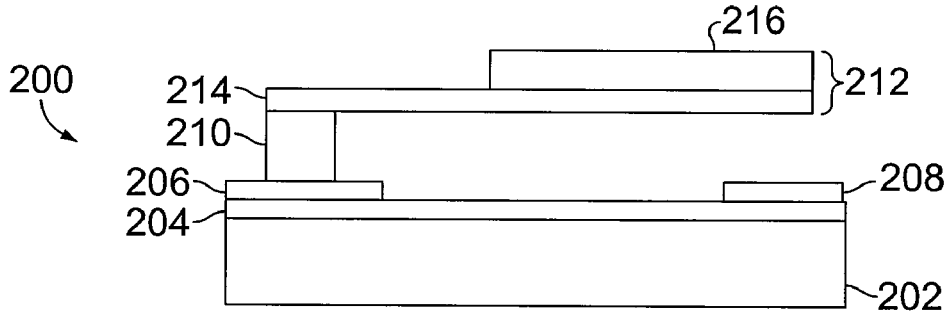
FIG. 2A illustrates a side view of a MEMS switch according to another embodiment of the invention.
Figure 2B:
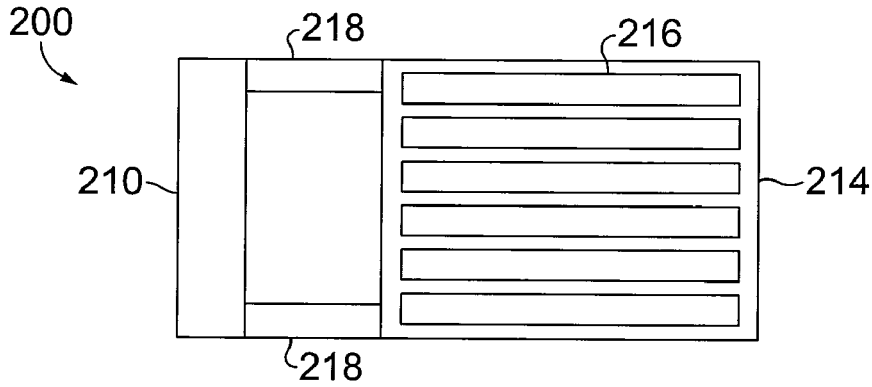
FIG. 2B illustrates a top down view of the MEMS switch of FIG. 2A.

FIG. 2A illustrates a side view of a MEMS switch according to another embodiment of the invention. FIG. 2B illustrates a top down view of the MEMS switch of FIG. 2A.

Referring to FIGS. 2A-2B, the MEMS switch is generally depicted as reference number 200. The MEMS switch 200 is formed on a substrate 202. In this embodiment, the substrate includes silicon. An insulating layer 204, e.g. $SiO_2$, SiN and the like, is formed on the substrate 202. An input contact 206 and output contact 208 are formed on the insulating layer 204. The input and output contacts are formed of a conductive material, e.g. gold or gold alloy. A support member 210 having a predetermined geometry, e.g., post, is formed on the input contact 206. The movable structure 212 is formed on the support member 210. In this embodiment, the movable structure 212 includes a support structure 214 and magnetic material 216 formed on the support structure.

In this embodiment, the movable structure 212 includes cantilever architecture having two or more beams 218 on the support structure 214. The support structure 214 is formed of gold having a thickness ranging from about 0.1 μm to about 5 μm. A magnetic material 216 is formed of NiFe thin film strips. The strips are formed to have a height of about 0.1 μm to about 100 μm. Patterning of the magnetic material into long narrow strips reduces the demagnetization field along the direction of the long axis. That is, the application of an external magnetic field results in magnetic dipoles on the surface of the magnetic strips. The magnetic dipoles create a magnetic field in opposition to the applied external field in the strips. This opposing field is called the demagnetization field, and the internal magnetic field is equal to the external magnetic field minus the demagnetization field. The demagnetization field is strongest in the smallest dimension of the strip and weakest in the largest dimension of the strip. The reason is due to the separation of the magnetic poles: the further apart between these magnetic surface charges, the less the interaction and the weaker the demagnetizing field. Therefore, when the aspect ratio of a strip is large (i.e. L>w>>h), the magnetization primarily aligns in the direction of L. Much smaller components of the magnetization also exit along the directions of w and h, but can be neglected due to the large demagnetization field in these directions. Optionally, additional layers may be formed on the plate (not shown), e.g., a gold layer, to reduce thermal-induced bending.

Figure 2C:
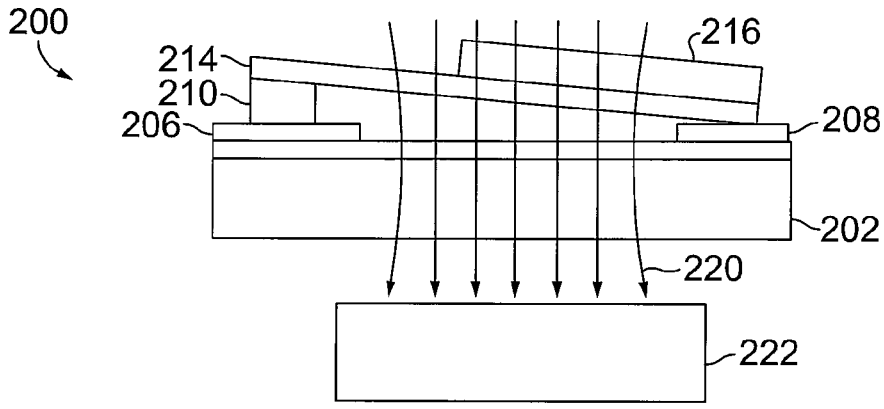
FIG. 2C illustrates a side view of the MEMS switch of FIGS. 2A-2B and operation of the same.

Referring to FIG. 2C, without an external magnetic field applied the contact of the switch is open as shown in FIG. 2A. When an external magnetic field 220 is applied via a magnetic source 222, the movable structure 212 moves by magnetic torque created by the interaction of the magnetic material 216 permitting contact of at least a portion of the support structure 214 with the output contact 208, thereby permitting an electrical current to travel from the input contact 206 to the output contact 208. In absence of the magnetic field the structure returns to the open position.

Figure 3A:
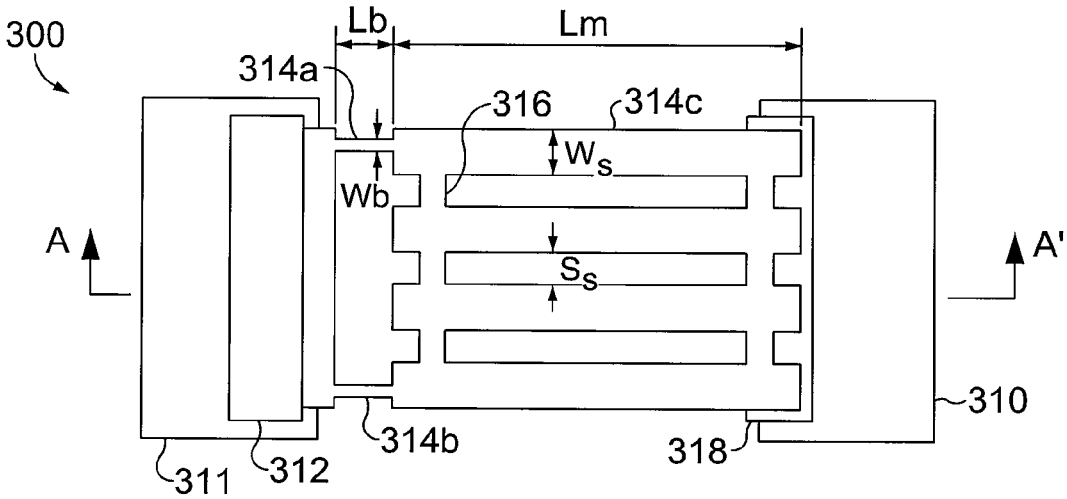
FIG. 3A illustrates a top down view of a MEMS switch according to another embodiment of the invention.
Figure 3B:
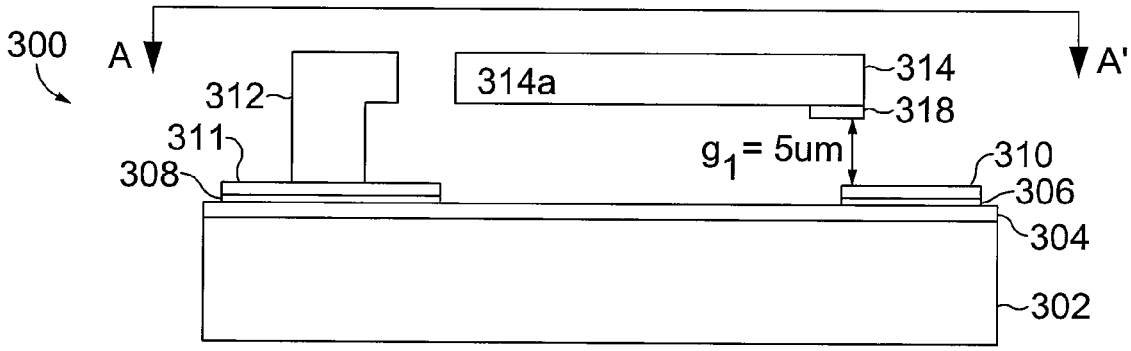
FIG. 3B illustrates a cross-section view of the MEMS switch of FIG. 3A along line A to A'.

FIG. 3A illustrates a top down view of a MEMS switch according to another embodiment of the invention. FIG. 3B illustrates a cross-section view of the MEMS switch of FIG. 3A along line A to A'.

Referring to FIGS. 3A-3B, the MEMS switch is generally depicted as reference number 300. The MEMS switch 300 is formed on a substrate 302 such as silicon (Si). An insulating layer 304 is formed on the substrate 302. The insulating layer 302 may be a dielectric layer, e.g., $SiO_2$, SiN and the like. An adhesive layer 306, 308. An input contact 310 and output contact 311 are formed on the adhesive layer 306, 308.

A support structure 312 having a predetermined geometry, e.g., post type geometry, is formed on the output contact 308. A movable structure 314 is formed on the support structure 312. The movable structure 314 may be formed into a number of different geometric configurations to permit flexure of the beam and/or minimize demagnetization effects. In this embodiment, the movable structure 314 is formed into a beam configuration of NiFe thin film strips.

More specifically, the support structure 314 has two beams 314*a*, 314*b* spaced apart and attached to the support structure 312. These beams 314*a*, 314*b*, have a length (Lb) of ranging from about 10 μm to about 300 μm and a width (Wb) ranging from about 1 μm to about 100 μm. These beams 314*a*, 314*b*, provide stiffness to the movable structure 314. The movable structure 314 has a main portion 314*c* having a length (Lm) ranging from about 100 μm to about 5000 μm or more. Preferably, the length (Lm) is about 300 μm to 1000 μm. The main portion 314*c* of the movable structure 314 is formed into a plurality of strips each having a width (Ws) ranging from about 10 μm to 500 μm and an empty space (Ss) ranging from about 1 μm to about 50 μm. The strips are connected with various connectors 316 as shown in FIG. 3B. A contact 318 is formed on an end portion of the movable structure 314. The contact is formed from a conductive material, e.g., gold.

Figure 4A:
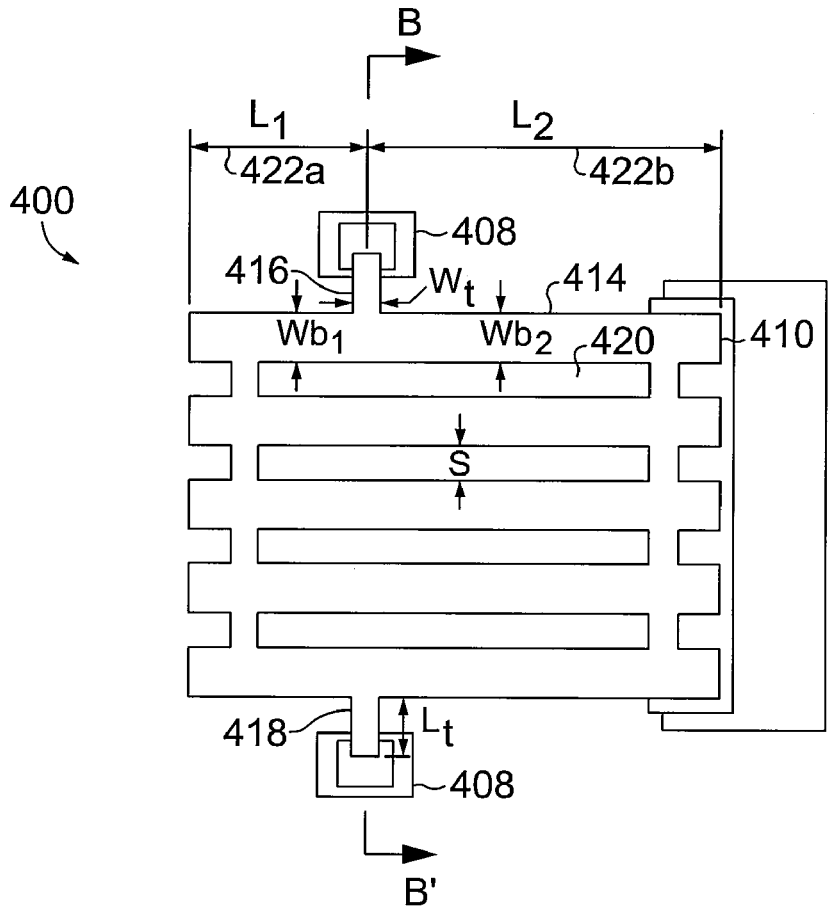
FIG. 4A illustrates a top down view of a MEMS switch according to another embodiment of the invention.
Figure 4B:
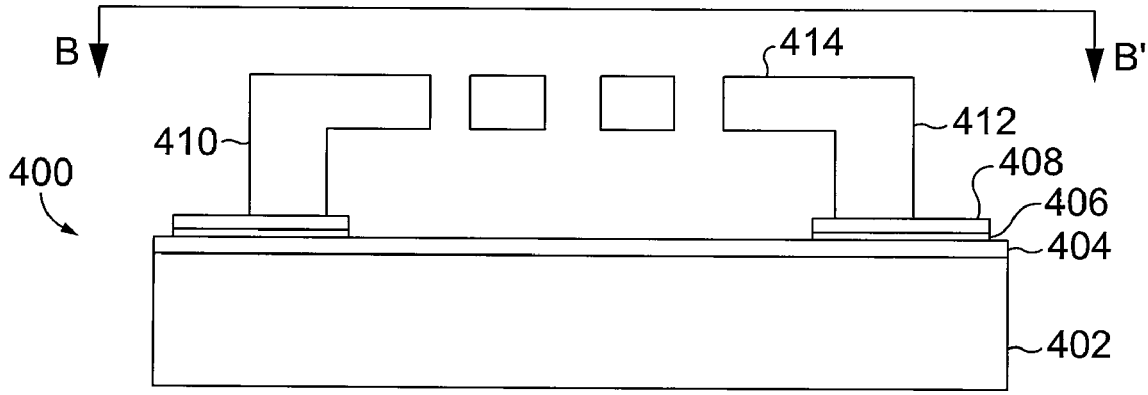
FIG. 4B illustrates a cross-section view of the MEMS switch of FIG. 4A along line B to B'.

FIG. 4A illustrates a top down view of a MEMS switch according to another embodiment of the invention. FIG. 4B illustrates a cross-section view of the MEMS switch of FIG. 4A along line B to B'.

Referring to FIGS. 4A-4B, the MEMS switch is generally depicted as reference number 400. The MEMS switch 400 is formed on a Si substrate 402. An insulating layer 404 is formed on the substrate 402. The insulating layer 404 may be a dielectric layer, e.g., $SiO_2$, SiN and the like. An adhesive layer 406, including titanium, chromium and the like, is formed on at least a portion of the insulating layer 404. Input contacts 408 are formed on the substrate 402. In this embodiment, there are two input contacts 408; these contacts are made with gold. The input contacts have a thickness of about 5000 Å.

In this embodiment, the MEMS switch 400 is configured to have torsion architecture. A first structure 410 and second structure 412 is formed in contact with the input contacts. A movable structure 414 is coupled to the first structure 410 and second structure 412 in an intermediate portion of the movable structure 414. In this embodiment, the movable structure 414 is coupled to a first torsion bar 416 and second torsion bar 418. The torsion bars 416, 418 have a width (Wt) of in the range from about 1 μm to about 100 μm and a length (Lt) in the range from about 10 μm to about 500 μm. The movable structure 414 has a predetermined geometry with a plurality of openings 420 formed with a plurality of interconnected thin magnetic film strips.

The magnetic strips 422 are now described in two different sections: a first section 422*a* leading to the torsion bars 416, 418 and a second section going from the torsion bars 416, 418 towards an opposite end of the magnetic strip 422. The first section 422*a* has a length (L1) ranging from about 50 μm to about 1000 μm and a width ($W_{b1}$) ranging from about of about 10 μm to about 500 μm. The second section 422*b* has a length (L2) ranging from about 50 to about 1000 μm and a width (Wb2) ranging from about 10 to about 500 μm. The first and second sections have a uniform thickness ranging from about 1 μm to about 100 μm. The spacing between the magnetic strips 422 may range from of about 1 μm to 50 μm. There are plurality of magnetic strips 422. The magnetic strips are formed from NiFe, CoFe and the like. Optionally, an additional layer, e.g., conductive or magnetic may, be deposited on top of the strips 422 in order to balance the stresses.

In operation, the movable structure 414 utilizes the torsion bars 416, 418 to rotate the movable structure upon an application of an external magnetic field (not shown). This embodiment has a high sensitivity to an external magnetic field as compared to the cantilever architecture. Compared to a cantilever architecture with magnetic strips of the same length, torsion architecture can achieve higher sensitivity due to its larger rotation angle.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A microelectromechanical system (MEMS) switch, comprising: a substrate; an input contact on the substrate; an output contact on the substrate; and a movable structure supported over at least a portion of the substrate, wherein the movable structure comprises a proximal end portion, an intermediate portion and a distal end portion and the movable structure is supported over at least a portion of the output contact, wherein the switch is capable of actuation from a first position to a second position upon an application of an external magnetic field, wherein the external magnetic field is not induced through an inductive component coupled to the switch and wherein the switch is capable of actuation from the second position to the first position upon a removal of the external magnetic field.

2. The MEMS switch of claim 1, wherein the movable structure comprises a magnetic material selected from the group consisting of Fe, NiFe alloy, and CoFe alloy.

3. The MEMS switch of claim 1, wherein the substrate is an insulated substrate.

4. The MEMS switch of claim 1, wherein at least one of the input contact and output contact comprises conductive materials selected from group consisting of gold, palladium, rhodium, ruthenium, and combinations of the same.

5. The MEMS switch of claim 1, further comprising a support structure, wherein the movable structure is on at least a portion of the support structure.

6. The switch of claim 2, wherein the magnetic material comprises thin film strips.

7. The switch of claim 1, wherein the MEMS switch is electrically connected to circuit devices on said substrate.

8. A microelectromechanical system (MEMS) switch, comprising: a substrate; an input electrode on the substrate; an output electrode on the substrate; an output contact on the substrate; a structure on the input electrode; and a movable structure on the input electrode, wherein the movable structure comprises a proximal end portion, an intermediate portion and a distal end portion and the movable structure is supported over at least a portion of the output contact by the structure coupled to the intermediate portion of the movable structure, wherein the MEMS switch is capable of actuation from a first position to a second position upon an application of an external magnetic field, wherein the external magnetic field is not induced through an inductive component coupled to the switch, and wherein the switch is capable of actuation from the second position to the first position upon a removal of the external magnetic field.

9. The MEMS switch of claim 8, further comprising an insulating film on the substrate.

10. The MEMS switch of claim 8, wherein the movable structure comprises a magnetic material.

11. The MEMS switch of claim 10, wherein the magnetic material comprises Fe, NiFe alloy, CoFe alloy and the like.

12. The MEMS switch of claim 8, wherein the input electrode and output electrode comprise conductive materials selected from the group consisting of gold, palladium, rhodium, ruthenium, and combinations of the same.

13. The MEMS switch of claim 8, wherein the movable support structure comprises a plurality of thin film strips arranged to have a space ranging from of about 1 to about 50 μm between the thin film strips.

14. The switch of claim 8, wherein said movable support structure is electrically connected to circuit devices on said substrate.

15. The switch of claim 8, wherein the substrate is selected from the group consisting of silicon, glass, silicon on glass, and plastic.

16. A microelectromechanical system (MEMS) switch, comprising: a substrate; an insulating layer on the substrate; an input electrode on the substrate; an output electrode on the substrate; and a movable support structure electrically coupled to an input electrode, wherein the movable support structure comprises a support structure and a plurality of thin magnetic strips on the support structure, wherein the movable support structure is capable of moving from a first position to a second position with an external magnetic field to activate the MEMS switch, wherein the external magnetic field is not induced through an inductive component coupled to the switch, and wherein the movable support structure has a torsion architecture.

17. The MEMS switch of claim 16, wherein the spacing between the thin film magnetic strips is about 11 μm to about 50 μm.

18. The MEMS switch of claim 16, wherein the thin film magnetic strips are about 1 μm to 100 μm in height.

19. The MEMS switch of claim 16, further comprising a material on the movable support structure.

20. The MEMS switch of claim 16, wherein the movable support structure is capable of moving from the second position to the first position with a removal of the external magnetic field.

* * * * *